US005657917A

United States Patent [19]

Johnson et al.

[11] Patent Number: 5,657,917

[45] Date of Patent: *Aug. 19, 1997

[54] FLIPOVER CARRYING DEVICE

[75] Inventors: Karen T. Johnson, Santa Monica; Lori T. Adams, Fremont, both of Calif.; April D. Montgomery; John W. Montgomery, both of Duncanville, Tex.

[73] Assignee: Inventus, Inc., Marina Del Rey, Calif.

[ * ] Notice: The term of this patent shall not extend beyond the expiration date of Pat. No. 5,337,934.

[21] Appl. No.: 291,569

[22] Filed: Aug. 16, 1994

Related U.S. Application Data

[63] Continuation-in-part of Ser. No. 900,615, filed as PCT/US93/06103, Jun. 18, 1993, Pat. No. 5,337,934.

[51] Int. Cl.[6] ..... A45F 4/02

[52] U.S. Cl. ..... 224/582; 224/153; 224/647

[58] Field of Search ..... 224/151, 153, 224/197, 202, 209, 210, 211, 213, 215, 227, 228, 236, 259, 260, 266, 901, 203, 182, 194, 269; 2/94, 102, 104, 247; 383/11, 106; 150/102; 190/109, 110, 111, 101

[56] References Cited

U.S. PATENT DOCUMENTS

| | | | |
|---|---|---|---|
| 44,993 | 11/1864 | Woods | 224/583 |
| 2,340,964 | 2/1944 | Kassner . | |
| 2,721,596 | 10/1955 | Danneil | 150/106 |
| 2,922,433 | 7/1960 | Roberge | 2/94 |
| 2,970,316 | 2/1961 | Silin | 224/209 |
| 4,096,978 | 6/1978 | Noice . | |
| 4,144,788 | 3/1979 | Zufich . | |
| 4,413,041 | 11/1983 | Leiserson | 190/110 |
| 4,483,469 | 11/1984 | Arisland | 224/151 |
| 4,555,812 | 12/1985 | Akers | 2/94 |
| 4,556,159 | 12/1985 | Swain | 224/269 |
| 4,561,576 | 12/1985 | Louretal . | |
| 4,563,777 | 1/1986 | Park | 2/94 X |
| 4,601,067 | 7/1986 | Buonassissi | 2/102 |
| 4,609,084 | 9/1986 | Thomas | 190/110 |
| 4,637,075 | 1/1987 | Ingrisano | 2/102 |
| 4,642,815 | 2/1987 | Allen | 2/2 |
| 4,669,125 | 6/1987 | Allen | 2/2 |
| 4,669,127 | 6/1987 | Swanson | 2/94 X |
| 4,767,039 | 8/1988 | Jacobs | 245/151 |
| 4,848,624 | 7/1989 | Clem | 224/901 |
| 4,904,351 | 2/1990 | Catenaccio . | |
| 4,940,173 | 7/1990 | Jacober | 224/151 |
| 5,054,127 | 10/1991 | Zevchak | 2/247 |
| 5,063,614 | 11/1991 | McSheffery | 2/94 |
| 5,160,073 | 11/1992 | Bateman . | |
| 5,161,722 | 11/1992 | Hembre . | |
| 5,165,111 | 11/1992 | Lieberman | 2/94 |
| 5,240,156 | 8/1993 | Sicotte et al. . | |
| 5,337,934 | 8/1994 | Johnson et al. | 224/153 |
| 5,437,403 | 8/1995 | Lemanski, II | 224/202 |

FOREIGN PATENT DOCUMENTS

| | | | |
|---|---|---|---|
| 8186662 | 2/1974 | Belgium . | |
| 2590458 | 5/1987 | France | 224/153 |
| 258203 | 6/1912 | Germany . | |
| 8707977 | 7/1987 | Germany . | |

OTHER PUBLICATIONS

The Journal of the America Medical Association, Oct. 18, 1958, vol. 168, No. 7 p. 930.

*Primary Examiner*—Henry J. Recla
*Assistant Examiner*—Gregory M. Vidovich
*Attorney, Agent, or Firm*—John W. Montgomery

[57] ABSTRACT

A carrying device for use by a wearer to carry possessions on the wearer's back and comprising a back panel supported adjacent a wearer's back, a moveable pouch supported adjacent the back panel in a first position and supportable adjacent the wearer's chest in a second position, a motion inhibitor interposed between the back panel and the pouch when the pouch is in the first position, and the pouch is attached in a position such that it is graspable by the wearer for moving the pouch from the first to the second position without removing the device.

9 Claims, 7 Drawing Sheets

FLIPOVER CARRYING DEVICE

CROSS-REFERENCE TO RELATED APPLICATIONS

This application is a continuation-in-part of and co-owned United States Patent Application entitled "Flipover Carrying Device" filed Jun. 18, 1992 and assigned Ser. No. 07/900,615, which issued Aug. 16, 1994 as U.S. Pat. No. 5,337,934 and which is related to PCT International Application Ser. No. PCT/US 93/06103, filed Jun. 18, 1993, both of which are incorporated by reference herein for all purposes as if fully set forth herein.

TECHNICAL FIELD OF THE INVENTION

This invention generally relates to carrying devices, more particularly to pouches which are carried on a user's back, as part of a backpack or otherwise, and which may be flipped over the user's shoulder for convenient access in the front of the user's body.

BACKGROUND OF THE INVENTION

Over the years, numerous types, sizes, and styles of carrying devices, backpacks, vests, and other packs have been made or proposed for use in conveniently carrying and storing various articles, such as clothing, books, camping gear, hunting gear, sports gear, baby items, and the like, on the user's back. Packs have been useful in all these contexts because they free the hands of the user for other activities and reduce bulk in the front of the user's body. However, users have always had to deal with the inconvenience of removing the carrying device, vest or other pack when it was necessary to gain access thereto. Some carrying device designers have attempted to minimize this problem by attaching smaller pockets to the front straps of the carrying device. However, this solution provides easy access to only a limited amount of space (since the size of the pocket must relate to the size of the strap to which it is attached and to the size of the user's chest) and leaves the user with a front pocket that restricts movement and space for hand carrying of other items or of an infant. Consequently, there has been a need for a larger pouch which could be easily accessed from the front of the body, but which retains the convenience of greater carrying space on the back. Similarly, while vests and other clothing articles have utilized pockets and pouches for storage of items, such pockets and pouches have been located on the front and sides of the garment where they are accessible to the user, or the user has had to remove the garment to access storage on the back.

SUMMARY OF THE INVENTION

Advantageous results have been attained by one feature of the present invention which provides means by which the most frequently needed items can be accessed simply by flipping a pouch or pouches over the user's shoulder from the back to the front of the body. When resting on the user's back, the pouch or pouches are resting on top of a back panel. The back panel may be on the back of a garment (such as a jacket, vest or overalls) or the back of a customary backpack bag, and the pouches are secured to it by a strap and a stabilizing patch, such as a hook-and-loop type attaching structure or a magnetic coupling. The strap may be in the form of a second shoulder strap, extending back from the neck of the user to the pouch and positioned over the shoulder of the user, and over either of the conventional carrying device straps, in the case of a carrying device. The user merely reaches back to the strap and pulls it so that the stabilizing patch, as with a hook-and-loop fastener, releases and permits the pouch to be readily disengaged and to "flip" to the front of the user's body. The interior of the pouch can then be opened as it rests on the user's chest by separating a closure, such as snaps, zippers, magnetic couplings, hook-and-loop material or other closure means that seals its end. Once the user has finished using the pouch, it can be returned to its position on the user's back just by flipping it back over the shoulder. The strap and pouch are uniquely constructed so that the natural rearward hanging position aligns the stabilizing patch of hook-and-loop material, magnetic or other removable attachment structure. The stabilizing patch, as with a hook-and-loop attachment material, rejoins when the pouch makes contact with the back of the backpack, garment or other carrying devices.

An additional feature of the invention provides small pull-off pockets secured to the sides of a main pack of a carrying device with hook-and-loop strips, which also can be pulled away from the main pack for access and returned to place while the carrying device remains in place on the user's back. These pockets permit small items such as money, clips, pens, small hunting accessories, or a baby bottle to be conveniently accessed by the user. The small pocket also can be attached to a hook-and-loop strip on the front of the carrying device straps if desired, but can be removed from the front and reattached at the side of the carrying device bag when front body space is needed.

A further feature of the invention extends a pull strap portion from the pouch to the front of the user. This permits the pouch to be conveniently pulled and flipped from a supported position at the user's back to an access position at the user's front. Repositioning the pouch to the back of the carrying device also is facilitated. The carrying device shoulder straps and the pouch access straps may be conveniently overlapped and may be held in position using mating hook-and-loop type fastener patches.

Another feature of the invention provides detachable pouches so that a variety of pouches can be selected and attached for different purposes or removed altogether. Shoulder snaps or zippers on a carrying device or garment or other carrying device and corresponding pouch support strap snaps or zippers are attached at the appropriate fold location for flipping the pouch over the wearer's shoulder. Strong-holding hook-and-loop or other detachable fastener means might also be used for providing detachable flipover pouches on a variety of backpacks, garments or other carrying devices.

Another feature of the invention is that stabilization patches, which are preferably comprised of mating hook-and-loop material but which may also be magnetic couplings and like detachable fasteners, are positioned both on the back panel and on the front of a pouch supporting backpack or garment or other carrying device with corresponding patches on the front and the back of the pouch so that motion of the pouch is inhibited with the pouch in a back supported position and motion is also inhibited in a front supported access position so that the pouch can be opened, accessed, and closed with one hand.

Another feature is that pouch supporting straps are reinforced laterally by sizing the strap material or by attaching a thin bendable plastic sheet to the pouch supporting strap. The lateral rigidity further facilitates the reliability and consistency with which the pouch returns to the same supported position for engagement with the stabilizing patch, as with the hook-and-loop motion inhibitor patches being aligned for engagement.

Another feature is that a compartmentalized tray is pivotable to a horizontal access position from a vertical carried position within the pouch for access into the tray from a horizontal orientation.

Another feature is that the pouch can be thermally insulated for maintaining a desired temperature of items carried within the insulated pouch.

Another feature is that a work tray is pivotable from a vertical carried position within a pouch to a horizontally supported orientation for work activities, such as writing, sorting parts or other work activities, for which a work tray may be beneficial.

Another feature is that the pouch can be padded or divided into a plurality of padded compartments for carrying delicate items, such as camera lenses.

Another feature is that the pouches can be constructed of flotation materials so that carrying capacity can be safely added to life preservers, life jackets, fishing vests, ski vests, and the like flotation devices.

According to another feature, the pouch is accessible from the front and the back as through zippered openings in the pouch front and in the pouch back.

Another feature is that the pouches are constructed with creased foldable sides and a creased foldable bottom so that the pouches can be flattened against the support panel when not carrying articles therein and can be expanded to accommodate articles when they are carried in the pouches.

Another feature is that a carrying device, such as a panel with bands for holding articles thereon, such as a pouch, is supported with a support panel, which support panel is an integral part of a garment and which support panel is adjacent to the wearer's body at a location away from the wearer's front torso. The carrying device is moveable with a grab strap within the reach of the wearer into a position in front of the wearer's torso where convenient access to the carrying device can be obtained.

Another feature is that the garment designated as a carrying device is a flotation device and the pouch is supported from the flotation device for rear carrying and flipover access at the wearer's front.

Another feature is that the garment designated as a carrying device is a garment, such as a jacket, and the pouch is supported from the jacket for flipover carrying and access.

Another feature is that the pouch is supported from a pair of overalls for rear carrying and flipover front access.

Another feature is that the pouch is supported from a shirt for rear carrying and flipover front access.

Another feature is that the pouch is supported from a vest for rear carrying and flipover front access.

Another feature is that the pouch is supported from a dress for inaccessible area carrying and flipover access in an accessible front torso area.

Another feature is that the pouch is supported from pants for inaccessible area carrying and flipover access in an accessible front torso area.

Another feature is that the invention may be applied to a garment with a flipover carrying device which includes a folded compartment. The accessible opening may be secured closed with magnetic couplings, snaps, hook-and-loop patches or other fastening means.

Another feature is that a flipover pouch may be accessed through a zipper opening.

Another feature is that a flipover pouch is constructed for holding air-tight containers.

Another feature is that a flipover carrying device is constructed for holding snack containers.

Another feature is that a flipover carrying device is constructed for holding a drink container with a closable conduit or straw for drinking access when said carrying device is flipped to a front access position.

BRIEF DESCRIPTION OF THE DRAWINGS

The foregoing and other advantages and objects will be more fully understood with reference to the following detailed description of the invention, claims, and drawings in which like numerals represent like elements, and in which:

DETAILED DESCRIPTION OF THE PREFERRED EMBODIMENTS

Figure 1:
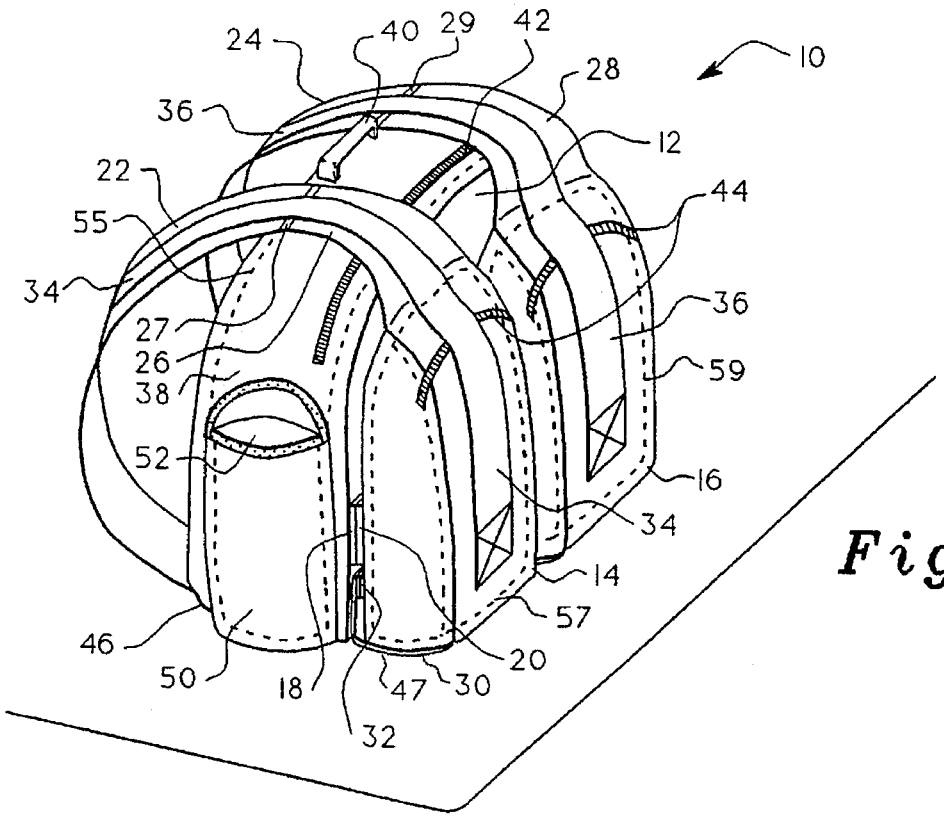
FIG. 1 is a schematic perspective view of one preferred embodiment of the invention.

FIG. 1 is a perspective view of a carrying device 10, such as a backpack 10 according to the present invention. It will be noted that throughout this application, the directions "left" and "right" are referred to with respect to the wearer's left and right, regardless of the position of the carrying device 10 as it appears in the drawings. Also throughout this application, the term "carrying device" will be used to mean any device for carrying possessions on the back of a person including but not limited to a conventional two shoulder strap-type backpack. For example, a pouch or a carrying bag supported on the back of a garment such as a vest, overalls, a jacket or a shirt is also intended to be included within the term "carrying device."

Figure 2:
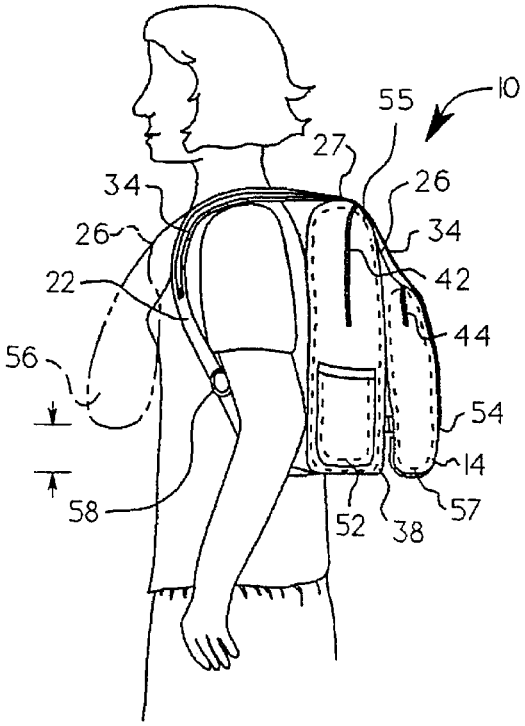
FIG. 2 is a side plan view of the flipover carrying device of FIG. 1 shown in place on the back of a user and with the flipover front position of the pouches shown in phantom lines.

The carrying device 10 includes a support panel 12, which may be positioned immediately adjacent to the wearer's back or spaced apart from but adjacent to the wearer's back (as shown in FIG. 2). For example, as in FIG. 1, there is a fixed carrying pack 38 interposed between the wearer and panel 12. A left enclosure or pouch 14 and a right enclosure or pouch 16 are positionable immediately adjacent the support panel 12. Interposed between the pouch 14 and the support panel 12 is a pouch fastener or stabilization patch 18 securely attached to the support panel 12 for releasable fastening of the pouch 14 to support panel 12. There is a corresponding pouch stabilization patch 20 securely attached on the underside of pouch 14.

In one preferred embodiment, the pouch stabilizing patch 18 and the corresponding patch 20 are correspondingly fastenable portions of hook-and-loop strips. For example, the "hook" portion of hook-and-loop strip is sewed or glued to the fabric of support panel 12 and the "loop" portion of hook-and-loop strip is sewed or glued to the fabric of pouch 14. While other releasable, fastenable patches might be suitable, hook-and-loop material has been found to be advantageously suitable as a releasable, fastenable material for purposes of this aspect of the invention. It has also been found that while the loop portion and the hook portion may be placed on either side so long as the correspondingly appropriate type of material is on the opposite side, it is nevertheless advantageous to place the softer of the two materials on the underside of the pouch. As will be explained more fully below, the softer, less abrasive material is thus exposed toward the front when the pouch is flipped over. In another preferred embodiment, the stabilization patch 18 and the corresponding stabilization patch 20 comprise a magnetic coupling, with mating pieces 18 and 20 of magnetic coupling material attached to the support panel or back panel 12 and the pouch 14, respectively.

The carrying device 10 is provided with the shoulder support strap 22 on the left and strap 24 on the right. Straps 22 and 24 are designed for placement over the wearer's shoulders and attached to the upper portion of support panel 12. Pouch 14 is attached to the support panel adjacent the attachment of shoulder strap 22 at a flexible attachment means 26, such as a strap or extension of the pouch fabric attached to the panel 12 through permanent stitching 27. Similarly, the right pouch 16 is attached at a flexible attachment means 28, which is preferably connected to the panel 12 with permanent stitching 29.

Pouch 14 has an access opening 30. In the embodiment shown in FIG. 1, the opening 30 is preferably at or near the bottom of the pouch and is closed with a closure means 32. The closure means 32 is preferably a releasable, fastenable material composed of hook-and-loop mating material. A zipper, snaps, elastic, or the like releasable closure might also be used with varying degrees of convenience.

Figure 5:
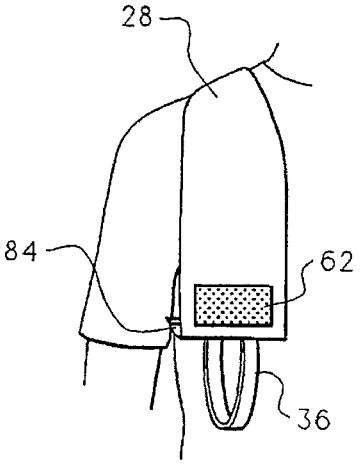
FIG. 5 is a front plan view of an alternative embodiment of a flipover pouch for use on the preferred embodiment of the present invention.
Figure 6:
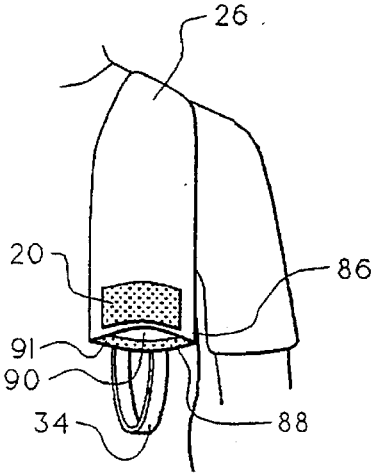
FIG. 6 is another alternative embodiment of a flipover pouch for use on the preferred embodiment of the present invention.

Alternative pouch construction might include a forward flap 31 (as shown at the wearer's left in FIG. 3), an elastic envelope without a flap 78, (as shown at the user's right in FIG. 3), a reverse flap 84 (as shown in FIG. 5), an end-to-end closure 91 without a flap (as shown in FIG. 6), a center opening flap construction or other selectively closeable constructions which allow for attachment to a stabilization patch. The pouch can be flipped over the user's shoulders, for example, by grabbing attachment means 26 or 28. However, as will be explained more fully with reference to FIG. 7, the backpack can be advantageously constructed with left pull strap 34 and right pull strap 36 to facilitate easy access.

In the preferred embodiment, the support panel 12 is the rearmost panel of a carrying pack 38. The carrying device may also be advantageously provided with a handle 40 to allow the main pack 38 and the pouches 14 and 16 to be conveniently hand carried, much as an ordinary satchel, when not on the wearer's back.

In the top of main pack 38, there is a top closeable access 42, which may be held closed with any known fastening and opening means, but is preferably a zippered opening 42. Advantageously, each pouch can also be provided with a closeable top pouch access 44, which may be a zippered opening. Both of the top access openings 42 and 44 provide convenient use of the carrying device as a satchel with a plurality of compartments, when not being transported on the wearer's back.

It is advantageous that the main pack 38 and the pouches 14 and 16 are uniquely constructed, such that their normal hanging positions are aligned along their respective bottoms 46 and 47, so that placement on a floor 48 or other flat surface 48 provides stability. Thus, the inventive carrying device construction reduces the tendency of ordinary backpacks to topple over. This has been found to be advantageous, for example, where the flipover carrying device, according to the present invention, is used as a "baby bag" for carrying various items for attending to infants, babies and small children. The ability to set the pack stably on a surface allows the guardian of a child to access both the pouches and the main pack in a convenient fashion when the pack is removed without the carrying device toppling over. However, as will be explained more fully below, the pouches of the backpack are also especially convenient for use without taking it off.

An auxiliary side pouch 50 may also be provided on the side of the main pack 38 to provide additional storage area. Auxiliary pouch 50 may comprise a small pull-off pocket which is detachably secured to the side of main pack 38. Auxiliary side pouch 50 is advantageously provided with a removable waterproof liner 52, which can be used for placing damp items inside the removable liner without soaking into the carrying device material. Such uniquely removable waterproof liners can also be used in other compartments of the carrying device, such as within the main compartment 38, or within pouches 14 and 16. Such a waterproof liner will provide the additional advantage of insulating the material of the pack from damp or soiled items, such as baby diapers and the like, and can be conveniently removed. Such liners may be disposable, but are preferably washable, as by tossing them into an automatic washer. Thus, the cleanliness and freshness of the carrying device is preserved in an environmentally and economically sound manner.

FIG. 2 is a side plan view of a wearer with an inventive carrying device 10 in a first position 54 shown in solid line, which is the normal carrying position for walking, standing or other activities. The hook-and-loop patches advantageously and automatically inhibit the motion of the pouches relative to carrying device. When the items carried in the pouches 14 and 16 are required to be accessed, the pouches can be flipped into the front of the wearer as shown with phantom lines in a second position 56, which is a convenient pouch access position. In the second or front position, the pouches are supported by permanent attachment straps 26 and 28. Also shown in FIG. 2 is a shoulder strap adjustment 58, which advantageously allows the wearer to adjust the length of the straps to the length of the shoulder straps 22 and 24 for comfortable carrying. It will be noted also that waist belts or hip support means (not shown) could also be attached for additional stability and carrying comfort if desired.

Figure 3:
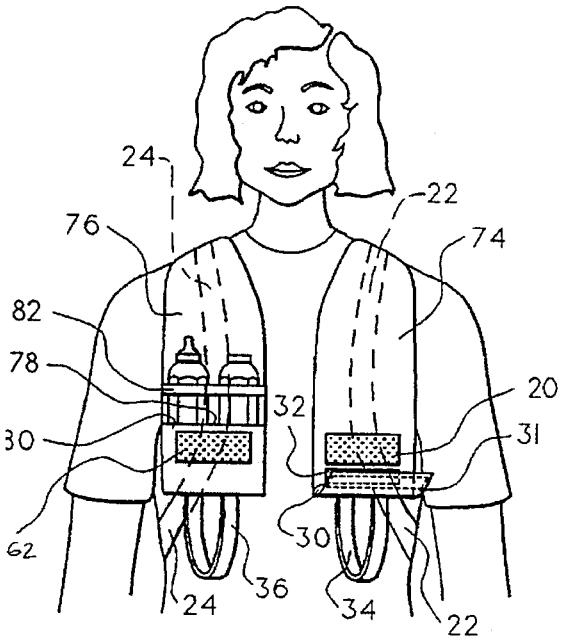
FIG. 3 is a front view of the flipover pouches in which alternate embodiments of the left and right pouches are shown flipped over to the front of the user for access.
Figure 4:
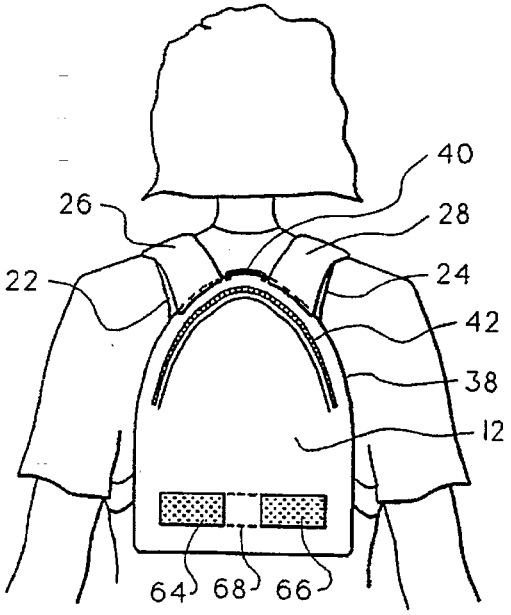
FIG. 4 is a rear plan view of the flipover pouches flipped to a front position showing the carrying device construction for attachment of the flipover pouches.

FIG. 3 is a plan view which shows two (2) alternative embodiments of pouches according to the invention in a front position for easy access to the contents of those pouches. In this view, the releasable fastener patch or panel 20 for the left pouch 14 and patch or panel 62 for the right pouch 16 are shown sewn onto the front panels of pouches 14 and 16, respectively. It will be noted with reference to FIGS. 3 and 4 together that the position of the releasable fastener patches 20 and 62 are designed to correspond to the position of corresponding fastener or pouch stabilization patches 64 and 66 on the support panel 12, as shown in FIG. 4 at the rear of main carrying compartment 38. The releasable fastener patches are preferably positioned toward the lower portion of the pouches and the support panel 12 to give maximum leverage for stability, this being accomplished by spacing the releasable fastener a maximum distance from the permanent attachment stitching 27 and 29 thereabove. It will also be noted that the patch portions 64 and 66 may be constructed of a continuous or interconnecting panel, as shown in phantom lines at 68. The convenience of such a construction with a single patch may be of greater advantage than the costs of additional material, as opposed to two separate patches, and may also facilitate rapid reattachment of the pouches.

In certain circumstances, it has also been found to be advantageous for purposes of convenient access to the main compartment 38 to position the left permanent pouch attachment 27 and the right permanent pouch attachment 29 below the main pack access opening 42. (Not shown) In particular, where a carrying device is to be removed frequently and placed on a surface, having all compartments accessible without movement of the pouches to their frontal position may be beneficial. Structural integrity is believed to be enhanced with both shoulder support straps and pouch support straps attached on the same side of access opening 42 as shown in FIGS. 1 and 3.

Referring again to FIG. 3, one preferred embodiment of pouch 14 is depicted at the wearer's left side, having a front panel 74 which completely encloses the pouch compartment. An openable portion 30 is covered, when access is not required, with a flap 31 held in position, as indicated previously with a strip of hook-and-loop material 32. It will be noted that the positions of hook-and-loop material 32 is below the releasable attachment panel or patch 20. It can be advantageous, for construction purposes, to have a vertically elongated releasable attachment panel 20 which serves both as a mating surface for patch 64 on support panel 12 and also serves as the mating portion for a narrow strip of hook-and-loop material 32 securely attached on the inside end of flap 31.

Shown at the right side of the wearer in FIG. 3 is an alternative pouch construction in which there is a back panel 76 having a pocket 78 formed at the lower portion thereof. In this embodiment of a pouch, according to the present invention, the hook-and-loop attachment patch 62 is on the front of pocket 78. The pocket 78 can be advantageously formed with an elastic upper border 80 to provide closure tension for items placed within the pocket. Further, for specialized carrying of elongated items such as bottles or baby diapers, an elastic support band 82 may also be formed on back panel 76. In the preferred embodiment, support band 82 is formed with an elastic material or fabric spaced above pocket 78, thereby holding elongated items in position, for secure carrying, yet easy access.

With reference to FIG. 5, another alternative construction of a pouch 14 is shown, in which there is a reverse direction pouch flap 84. Such a reverse direction pouch flap 84 is found to be advantageous for purposes of providing secure detachable engagement between the corresponding hook-and-loop panels 20 and 64. The accessibility into the pouch is reduced slightly, but is objectionably hindered when the pouch is flipped to its frontal position.

FIG. 6 shows another alternative preferred pouch construction in which a front panel 86 and a back panel 88 are of equal lengths, so that they are connected or sewn along their sides. Both panels 86 and 88 end evenly at an access opening 90. The access opening 90 can be closed with corresponding strips of hook-and-loop material, a zipper, or other openable fastening means 91.

Figure 7:
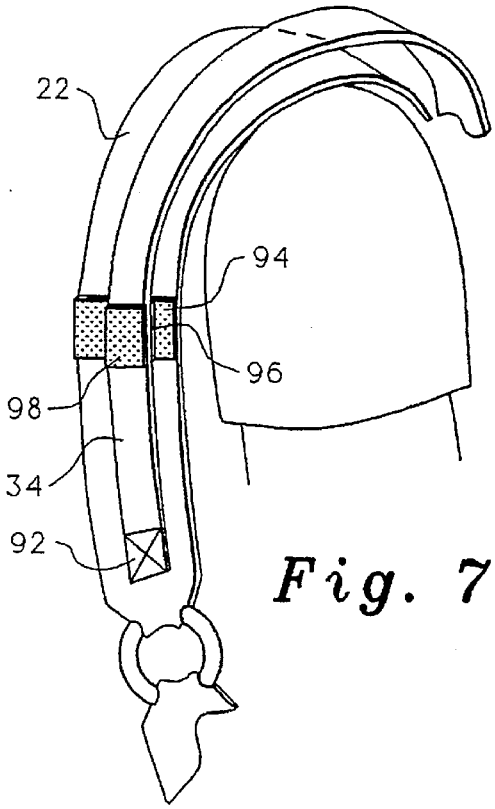
FIG. 7 is a partial view showing the unique double strap construction for convenient flipover access to the pouch according to the preferred embodiment of the present invention.

FIG. 7 shows a partial portion of a support strap 22 and a flipover pull strap 34 in a perspective view. The preferred construction is shown, in which the pull strap 34 is attached in the front toward a lower portion of shoulder strap 22 at a secure attachment area 92, such as a strong-holding fabric stitching attachment 92. The pull strap 34 is preferably attached to the back of the pouch toward the lower end thereof, so that pulling the strap 34 causes the hook-and-loop patches 20 and 64 to be released. Upward on shoulder strap 22 from the attachment area 92, a hook-and-loop stabilizer pad 94 is advantageously provided attached to and facing outwardly from strap 22. A corresponding hook-and-loop stabilizer connection pad 96 is attached to and facing inwardly from the underside of flipover pull strap 34. Thus, when the carrying device pouch 14 is placed in its back carrying position, the flipover strap 34 can be pushed against the shoulder strap 22 to engage hook-and-loop pads 92 and 96. The pull strap is thereby maintained in position so that it does not fall off of the user's shoulder or otherwise flop down and get in the way.

It has also been found that in certain situations, it may be desirable to provide an accessory attachment pad 98 on the exterior of shoulder strap 22, or pull strap 34, by which items such as bottles, rattles, pacifiers, etc. can be applied with a corresponding loop-and-hook or hook-and-loop pad 98 to thereby hold them on the strap. Such an accessory attachment loop-and-hook pad 98 can beneficially be formed of the same loop material or the hook material as the strap stabilizer pad 94, and can be designed to be immediately adjacent to the pad 94 to thereby benefit by and enlarged area of the accessory attachment patch of loop-and-hook material.

Figure 8:
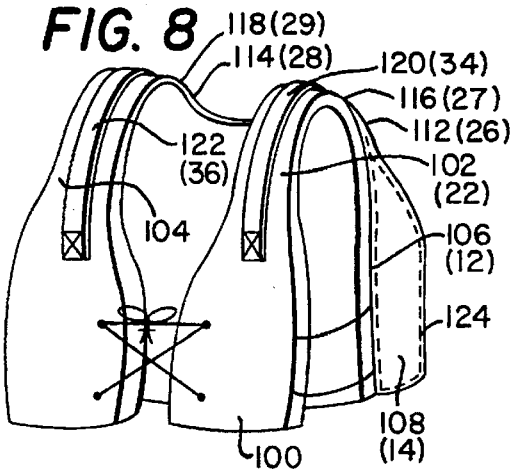
FIG. 8 is a schematic view showing the invention as applied to a flotation device.

Referring now to FIG. 8, which is a schematic perspective view of a life preserver or a flotation vest 100, with the inventive flipover pouches applied thereto. Such flotation devices as life jackets, ski vests, fishing vests and the like have become popular, and in some locales, it is mandatory that persons operating watercraft or those riding in such watercraft must have an appropriate flotation device for purposes of safety. It is also a good idea with the increasing number of persons undertaking recreational water sports that an appropriate flotation device be worn whenever one is in a boat or other watercraft. When one is wearing such a life vest 100, access to equipment or supplies can be somewhat limited. It has been found that, typically, life jackets and life vests will have a left shoulder strap 102 and a right shoulder strap 104, which support a back panel 106, all of which are appropriately constructed with flotation material, such as styrofoam or polyfoam, or otherwise constructed or filled with flotation material, or fillable with buoyant material such as an air balloon, pressurized $CO_2$ or the like to provide flotation in an emergency.

In the embodiment shown in FIG. 8, the life vest 100 is of the type having a foam fill material. The shoulder straps 102 and 104 may have, appropriately attached thereto, support straps 112 (corresponding to 26 of FIG. 1) and 114 (corresponding to 28 of FIG. 1) from which flipover pouches (corresponding to pouches 14 and 16 in FIG. 1, not shown in FIG. 8) may be appropriately supported in a first supported position adjacent to the back panel and attached thereto with strips or patches of hook-and-loop material 18 and 20 (not shown in FIG. 8), as was described with respect to FIG. 1, above. The pull-over straps 120 (corresponding to 34 in FIG. 1) and 122 (corresponding to 36 in FIG. 1) may also be appropriately attached for easy flipover access into the flipover pouches. It will be understood with reference to the description of FIGS. 1–7, above, and also with references to the multiple alternative backpack and pouch designs in FIGS. 9–33, below, that the particular configuration of pouch 108 (14) or the means 116 (27) and 118 (29) for attachment to the existing shoulder straps 102 and 104 may be varied within the scope of the invention for the particular purpose or activity desired.

As indicated above, the term "carrying device ", as used herein, will mean any device for carrying possessions on the back of a person, including, but not limited to, conventional backpacks, garments, vests, dresses, overalls, trousers, shirts, jackets, wheelchair backs, flotation devices and others. Also, throughout the description of the figures, it will be understood that the specific depictions are not intended to limit alternative shapes, sizes, attachments and configurations of flipover pouches according to the present invention, but rather, is for demonstrative purposes only. The attachment of the pouch support straps at 27 or 29 may be through stitching, snaps, buttons, strong-holding hook-and-loop material, threaded fasteners or zippers. The closures of the pouch access openings may be accomplished with snaps, buttons, zippers, magnets, hook-and-loop fasteners, press-together seals and the like. Pullover straps may be stitched to the front, or they may be removably secured as with buttons, snaps, strong-holding hook-and-loop fasteners or the like.

Figure 23:
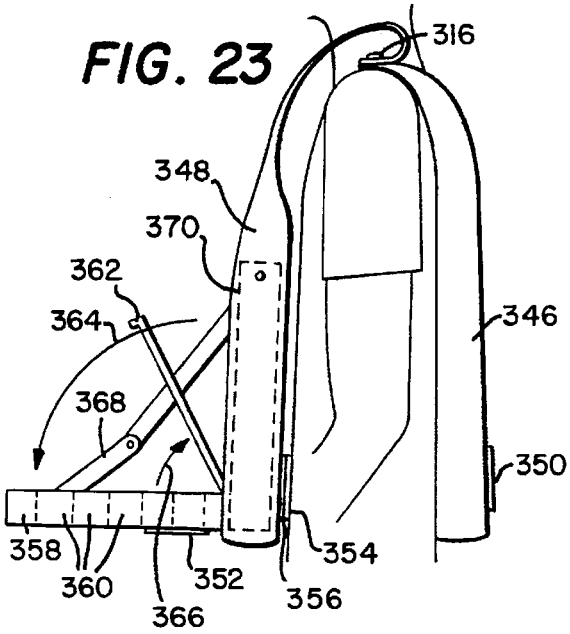
FIG. 23 shows a pouch with a compartmentalized tray which is pivotable to a horizontal access position from a vertical carried position within the pouch.

For example, a carrying device, which is a fishing vest, may include flipover pouches comprising a multiple compartment tray, as depicted in FIG. 23, below. In a preferred embodiment for a carrying device flotation device 100, the pouch 108 (corresponding to pouch 14 of FIG. 1) may be constructed with additional flotation material 124, so that the intended content of the pouch will be floated by the buoyancy of the construction flotation material 124. Thus, the addition of such a pouch 108 should not interfere with the intended safe flotation when the pouch is full. In the event that the pouch is not completely full, it will provide additional buoyancy beyond that of a similar flotation device without flipover pouches 104.

Figure 9A:
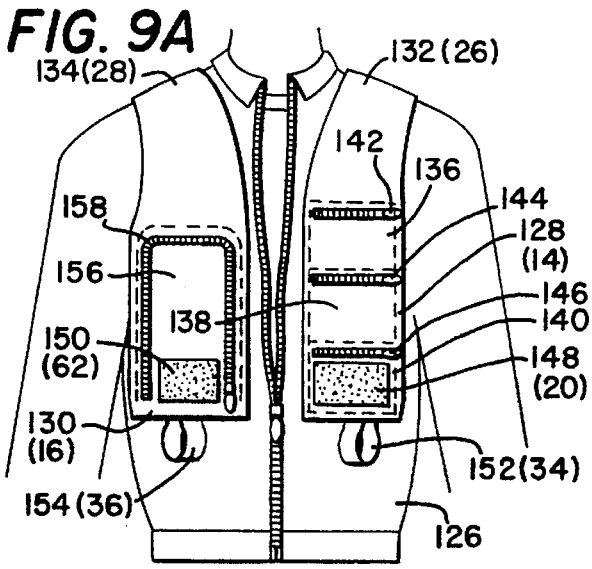
FIG. 9A is a schematic front view showing the invention as applied to a garment, such as a jacket.

FIG. 9A is a front elevation view of a garment 126, which garment corresponds to a "carrying device" according to the present invention, and in the particular embodiment shown may be a jacket 126, which has a left pouch 128 (corresponding to left pouch 14 of FIG. 1) and a right pouch 130 (corresponding to right pouch 16 of FIG. 1), a left support strap 132 (corresponding to left support strap 26 of FIG. 1) and a right support strap 134 (corresponding to right support strap 28 of FIG. 1). The left pouch 128 is depicted with a plurality of separately accessible pouch enclosures 136, 138 and 140, each having corresponding access devices, such as zippers 142, 144 and 146. Secured to each pouch 128 and 130 is a stabilizing patch, such as a patch of hook-and-loop material 148 and 150 (corresponding generally to patches 20 and 62, as depicted in FIG. 4 with respect to a prototypical backpack, uniquely fitted with flipover pouches). Pullover straps 152 and 154 (corresponding to pull straps 34 and 36 of FIGS. 1 through 6) are also depicted in their forward looped position. Right pouch 130 is also depicted with a single compartment 156, having a single inverted "U"-shaped access zipper 158.

Figure 9B:
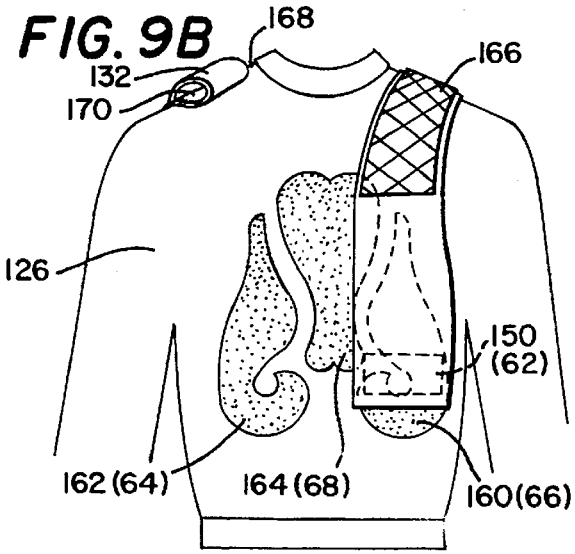
FIG. 9B is a schematic back view of the invention applied to the garment or jacket of FIG. 9A.

FIG. 9B depicts a back view of a garment or jacket 126 of FIG. 9A, having a left pouch 128 shown in a second supported position or the forward flip direction, with the right pouch 130 shown in a rearward back panel-supported first position. For clarity, the pullover straps 152 and 154 are not shown in FIG. 9B, although, if used, would be attached as described elsewhere in this application.

In the embodiment of FIG. 9B, the stabilizing patches are hook-and-loop patches 160, 162 and 164, which are depicted having an ornamental design or decorative pattern, which may advantageously serve as a feature of a jacket to disguise the hook-and-loop patches. The particular designs depicted are not intended to be limiting, but rather are merely examples of creative decorative design patterns as may be used to facilitate ornamentation of carrying devices, such as jackets, vests, clothing of various types, as well as standard backpacks. This feature is particularly advantageous for clothing to be used as a carrying device and having back panels for receiving the flipover pouches in their supported position, but which are also adapted for detachable attachment of pouches onto the jackets, vests, backpacks or other clothing as will be discussed more fully with reference to the figures and descriptions, below. It will also be noted with reference to FIG. 9B that the support strap 134 of pouch 130, which is shown in its rearward position, has been provided with a rigidifying panel 166, which is schematically depicted with "X" hatching. This rigidifying panel 166 is for the purpose of facilitating straight pouch alignment in the rearward first supported position, so that the pouch 130 attaches to the patch 160 properly aligned for connection between interconnecting stabilizing patches 150 and 160. The rigidifying material 166 may be incorporated within the fabric of the pouch itself, such as extra-rigid nylon fabric, canvas fabric or vinyl material, or it may be a layer of thin plastic, cardboard or other rigidifying sheet material attached to, or secured within, the support strap 134. Alternatively, rigidification 166 might be formed with appropriate sizing chemicals and treatment.

Also depicted in FIG. 9B is the strap 132 for pouch 128 (which is in its forward, second supported position), which strap 132 is attached to shoulder 168 of jacket 126. Although the attachment is depicted schematically as a line 170, which, according to previous description of the invention, may, for example, be a line of stitching along the crest of the shoulder, it will become apparent with reference to the figures, below, and particularly FIGS. 21, 22, 23, 25 and 26, that the attachment to the jacket might alternatively be accomplished with a detachable fastening mechanism, such as snaps, extra-strength hook-and-loop fasteners, buttons, threaded fasteners, zippers or the like, which can be removably fastened so that carrying devices, including the jacket 126 or other wearing garments can be selectively used with or without the unique flipover pouches, thereby facilitating versatility and usefulness of the invention. Again, using ornamental patches of hook-and-loop material or incorporating patches of hook-and-loop material into portions of ornamentation will further enhance the usefulness of the invention by disguising the hook-and-loop motion-inhibiting patches.

Figure 10:
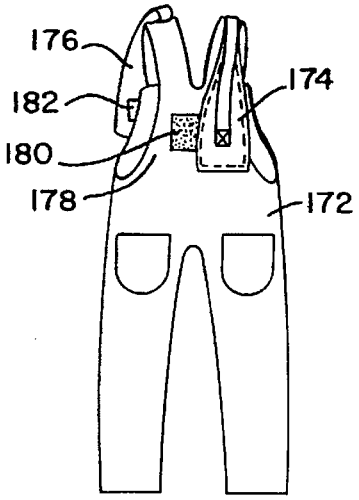
FIG. 10 is a schematic view showing the invention as applied to a pair of overalls.

The embodiment depicted in FIG. 10 shows a rear elevation view of a pair of overalls 172 to which flipover pouches 174 and 176 have been attached, according to the invention. The back panel 178 of the overalls 172 is provided with a patch 180 of hook-and-loop material, which patch 180 mates with corresponding patches of hook-and-loop material on pouches 174 and 176, as, for example, patch 182 shown on pouch 174.

Figure 11:
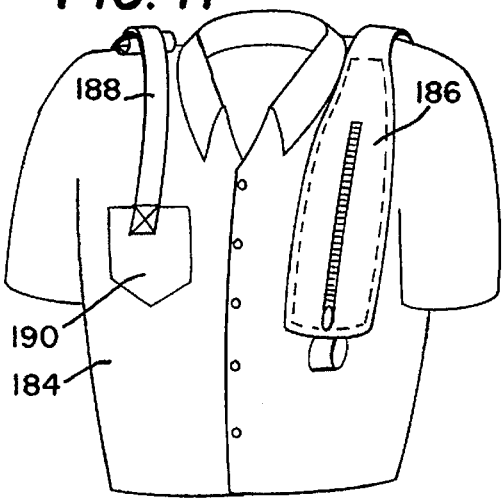
FIG. 11 is a schematic view showing the invention as applied to a shirt.
Figure 17:
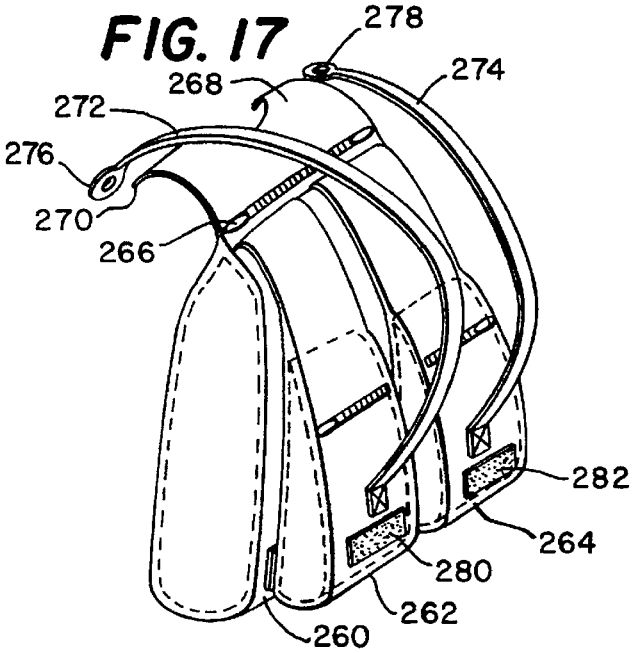
FIG. 17 shows a pouch construction with access through zipper openings and which demonstrates magnetic coupling devices, such as stabilization patches.
Figure 21:
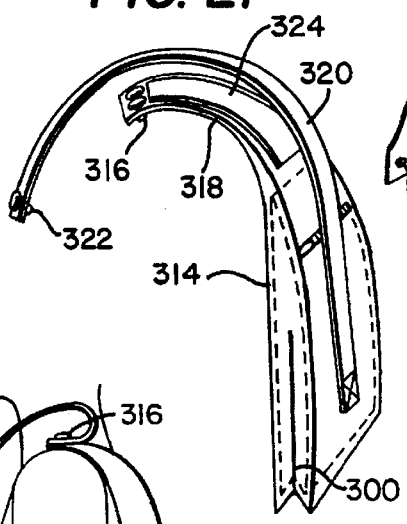
FIG. 21 shows a pouch constructed with creased foldable sides and a creased foldable bottom so that the pouches can be flattened against the support panel.
Figure 26:
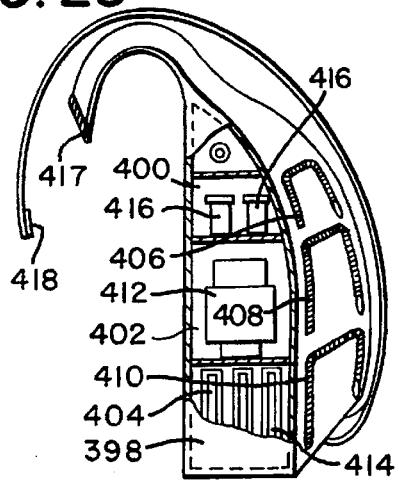
FIG. 26 shows a pouch which is padded or divided into a plurality of padded compartments for carrying delicate items, such as camera lenses.

With reference to FIG. 11, the carrying is a shirt 184, which is shown having one embodiment of the flipover pouches attached, according to the invention. Particularly, a pouch 186, according to the present invention, is shown in a forward position. The other pouch is in a rearward position, depicting only the pull strap 188, which pull strap 186 may, for example, be attached at the wearer's front, as, for example, to a shirt pocket 190. In the case of one or more detachable flipover pouches, the attachment of strap 188 may be accomplished using a shirt pocket button (such as shown in FIG. 17), using a snap (such as shown in FIG. 21) or using another patch of hook-and-loop material (such as shown in FIG. 26), or otherwise with removable fastener mechanisms as described herein.

Figure 12:
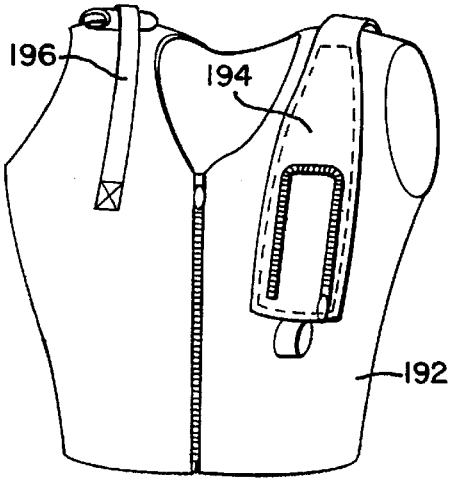
FIG. 12 is a schematic view showing the invention as applied to a vest.

FIG. 12 depicts a vest 192 having a pouch 194, shown in a forward position, with pull strap 196 shown extending rearward to the other flipover pouch (not shown) for convenient pullover to a forward position. The schematic depiction of the vest in FIG. 12 is not intended to limit alternative shapes, sizes, attachments and configurations of vests or of flipover pouches, according to the present invention, but rather, is for demonstrative purposes only.

Figure 13:
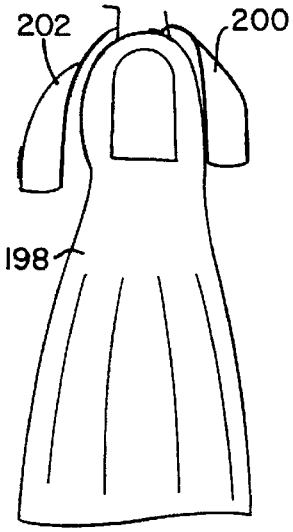
FIG. 13 is a schematic view showing the invention as applied to a dress.

FIG. 13 shows a side elevation view of a dress 198 to which flipover pouches 200 and 202 are shown attached. Pouch 200 is in a rearward carrying position and pouch 202 in a forward accessible position.

Figure 14:
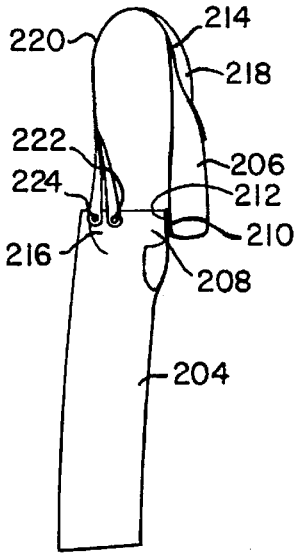
FIG. 14 is a schematic view showing the invention as applied to trousers or pants.

FIG. 14 is a schematic depiction of a pair of pants 204 or trousers 204 to which a flipover pouch 206 has been attached in a backpack configuration, according to one alternative embodiment of the invention. In this embodiment, the support panel 208 is positioned away from the wearer's front, as at the rear waist or at the seat of the pants 204. Hook-and-loop attachments 210 and 212 are respectively positioned on pouch 206 and pants 204 for motion-inhibiting, detachable engagement. The support strap 214 extends from the separate support panel 208 and to the front of the wearer, as, for example, over the wearer's shoulder and may be attached to the front 216 of trousers 204. Again, in the preferred embodiment, pull strap 218 will also be extended from pouch 206 to a forward position 220. Schematically depicted are strap attachment means 222 and 224, such as buttons 222 and 224, to which the support strap 214 and/or the pull strap 218 may be attached. In this manner, a pair of trousers 204, which are adapted with flipover pouches 206, a stabilizing patch 210 and with appropriate button or buttons 222 and 224, may become usefully adapted as a flipover, according to one alternative embodiment of the present invention.

Figure 15:
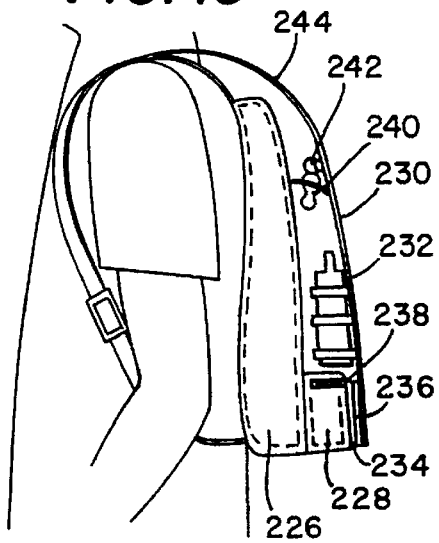
FIG. 15 shows a carrying device with externally attached items for access to attached items.

FIG. 15 is a schematic side elevation view of an alternative embodiment of the invention in which a backpack 226 comprises a main pack 228 and a flipover pouch 230, which is preferably made of a flat, relatively rigid material. Rather than pouch openings, which are totally closeable, as previously described and disclosed, the flat pouch panel 231 is provided with pockets of fabric or with openings formed by loops 232, which may be formed of elastic strips and into which containers, such as bottle 234, may be detachably secured for easy access when the pouch panel 231 is moved to its forward supported access position. The main pack 226 has a secondary pocket 238 on which a back support panel 240 is provided with a patch 232 of hook-and-loop material, which corresponds to a patch 244 of hook-and-loop material, on the relatively rigid "pouch" panel 232 to which the elastic loops 232 are attached. Also, as depicted, other items may be carried, such as a pacifier, a compass, a tool or other item 238, may be hooked at 240, as depicted. The operation of the "pouch" 232 is as previously described with respect to flipping over from a stabilized first position adjacent to the support panel 240 to a second forward supported position at which support strap 244 holds the pouch-attached items accessibly adjacent to the wearer's front.

Figure 16:
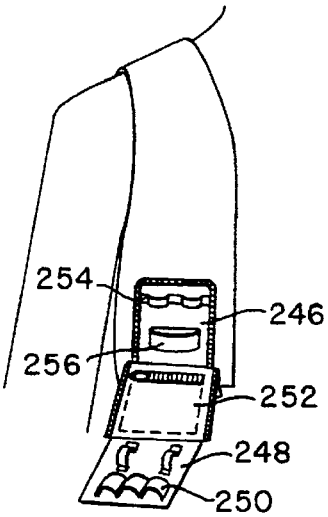
FIG. 16 shows a pouch construction which includes folded compartments and which shows magnetic closure means for the pouch opening.

FIG. 16 shows an alternative embodiment of a pouch opening 246 by which a folded compartment 248 becomes accessible, which compartment may include multiple folds and panels. Such a compartment may include holding loops 250, separate openable pockets 252 or other alternative carrying or attachment hooks 254 and 256, such as elastic hooks, elastic loops, flexible hooks and sealable containers and the like, which have become popular as in folded first-aid kits or folded cosmetic packets and the like.

FIG. 17 depicts another alternative embodiment of an inventive carrying device 260 with flipover pouches 262 and 264, according to the present invention, in which the carrying device 260 may be detachably secured as at zipper 266 to a garment schematically depicted as 268, having material extending forward over a wearer's shoulders as at 270. The pull straps 272 and 274 are depicted having button attachment orifices 276 and 278, so that, as, for example, shirt pocket buttons may be used on the garment to removably hold the pull straps 274 and 276 in a position where the wearer may access them. Other attachment means for the pull straps, such as strong-holding hook-and-loop fasteners, strong-holding magnetic couplings, snaps and threaded fasteners, might also be used, similar to the button attachment depicted. Also depicted on pouches 262 and 264 are rearward-facing patches 280 and 282 of hook-and-loop material, which can be removably attached to corresponding hook-and-loop material for additional front support to prevent unwanted movement of the pouches when in a forward position, thereby facilitating ease of access. Motion inhibitor patches 284 and 286 are depicted as magnetic mating coupling material.

Figure 18:
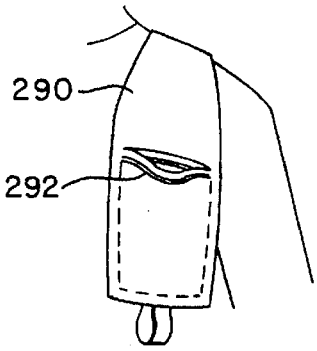
FIG. 18 shows a pouch construction with air-tight containers.

Referring now to FIG. 18, which is a front elevation view of a pouch 290, which has a hermetically sealable opening 292, for use in situations such as boating, and particularly, as, for example, in life vests for kayaking and the like, where watertight compartments will be particularly useful.

Figure 19:
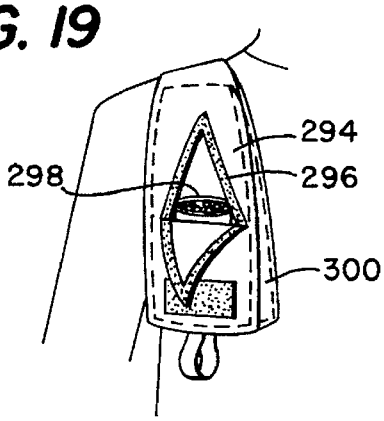
FIG. 19 shows a pouch construction with snack containers.

FIG. 19 schematically depicts in a partial front perspective view an alternative embodiment of a flipover pouch 294 having an inverted "V"-shaped pouch opening 296, which, for example, may conveniently hold snack 298 or the like. Pouch 294 is shown in a construction having collapsible sides 300 by which the pouch may be collapsed to a flat condition when it is not filled with any items to be carried.

Figure 20:
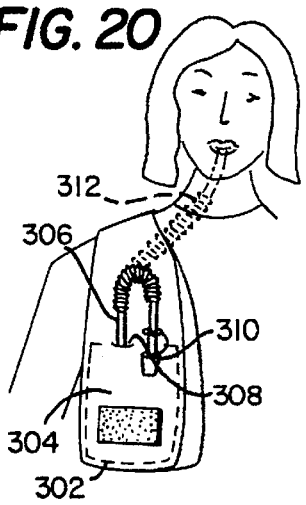
FIG. 20 shows a pouch construction with a drink container holder with straw drinking access.

FIG. 20 schematically depicts a flipover pouch 302, which is uniquely constructed, as for the addition of a drink container 304 which can be contained therein. The drink container may conveniently and advantageously be provided with a flexible straw 304 through a sealed opening 306, which flexible straw can be in a closed position 308 or may be extended to a drinking position depicted in phantom lines at 312, so that the wearer may easily pull the pouch to the front and access the drink without spillage and without the distraction or cumbersomeness of an exposed straw when the pouch is in the rear position.

FIG. 21 schematically depicts one preferred alternative embodiment of a flipover pouch 314, which is constructed with a "V"-shaped collapsible side 315, so that the pouch may be in a flattened condition when not in use, thereby reducing any bulkiness of a garment. Also, schematically depicted are snap attachment means 316 by which the support strap 318 of the pouch may be removably affixed to a garment having corresponding engaging snaps (as may be more fully understood with reference to FIGS. 23 and 265, in which flipover pouches are depicted snapped to a wearer's garments at the shoulder). Also, the pull strap 320 is provided with a removably engagable snap 322, which snap 322 serves the purpose of a pullover strap attachment means as with buttonholes 276 and 278 in FIG. 17 and which might also be constructed with other removable attachment means, such as hook-and-loop fasteners, magnetic coupling or other conveniently engageable and disengageable fastener mechanism.

Also, schematically depicted in FIG. 21 is a reinforcing panel 324 by which the support strap 318 is rigidified to facilitate proper alignment of pouch 314 when in its rearward supportive position. This is particularly advantageous where the collapsible material of the pouch 314 is not as thick or does not have the structural body or stability as with some carrying device fabrics. The support panel 324 may be a separately attached or enclosed sheet of plastic or cardboard, or may be provided by embedding sizing material into the otherwise less rigid fabric of pouch 314.

Figure 22:
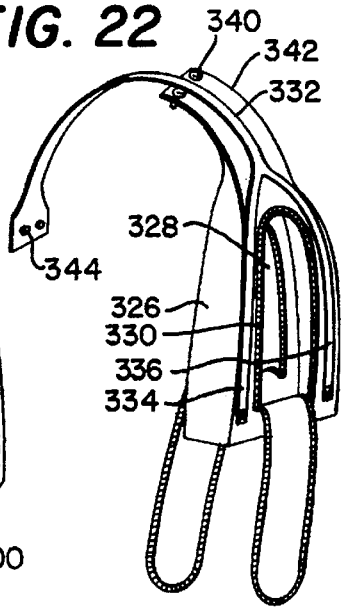
FIG. 22 shows a pouch which is accessible from the front and from the back as through zippered openings in the pouch front and in the pouch back.

FIG. 22 depicts a removably attachable pouch 326, which is provided with front and rear access openings 328 and 330. Also, the pull strap 332 is uniquely constructed with a plurality of attachment straps 334 and 336, which may be positioned and attached on the pouch in a manner which will avoid interference with access openings 330 when the pouch is in its rearward position. Again, detachable connectors 340 for the support strap 342 and detachable connectors 344 for pull strap 332 are depicted. In the embodiment shown, the detachable connectors 340 may be, for example, short, flat, threaded screws made of metal or a durable plastic or polymer, such as a polycarbonate material, with corresponding nuts or threaded orifices formed or otherwise attached on the shoulder of a garment for removable attachment of a pouch 326 thereto.

FIG. 23 depicts another alternative embodiment of carrying device 346 and a flipover pouch 348 having matched hook-and-loop patches 350 and 352 for inhibiting movement when the pouch 348 is in a rearward position. Also, as discussed with another embodiment previously, front motion inhibitor patches 354 and 356 may be advantageously provided for holding pouch 348 in its front position for easy access to the contents of the pouch. In the alternative embodiment depicted in FIG. 23, the pouch is provided with a plurality of a tray 358, and the foldout tray 358 has a plurality of separately accessible compartments 360, such as a tray for fishing lures or a tray for small parts, as a repairman might use. The compartments 360 may be closed, with the door 362, which moves to a closed position as shown with arrow 364, and moves to an open position as shown with arrow 366. The tray 358 is preferably supported in a substantially horizontal position, as with a folding arm 368. When in its folded and upright position, depicted schematically with hidden lines 370, the pouch is in a substantially flat condition so that it is no more cumbersome than an ordinary backpack.

Figure 24:
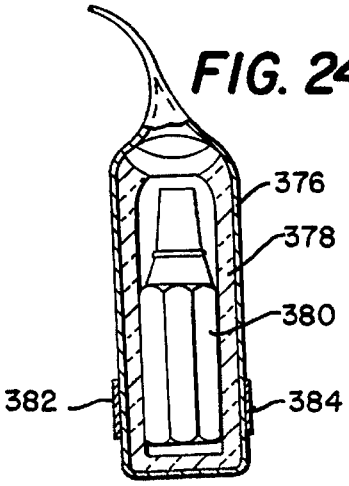
FIG. 24 shows a pouch which is thermally insulated.

FIG. 24 is a partial side cross-sectional view of an insulated pouch 376, which may be lined with an insulating foam or other insulating material 378, so that hot or cold containers, such as a chilled milk bottle 382, may be held therein for an extended period of time to prevent spoilage or to otherwise provide a beverage or a comestible product at a temperature at which the product is most palatable. Again, the pouch 376, depicted in FIG. 24, is provided with both a rear position patch of hook-and-loop material 382 and also with a front supporting hook-and-loop material 384, which will facilitate ease of access into the insulated pouch 376. As with a baby bottle, access with one end can be very advantageous when holding an infant with the other hand.

Figure 25:
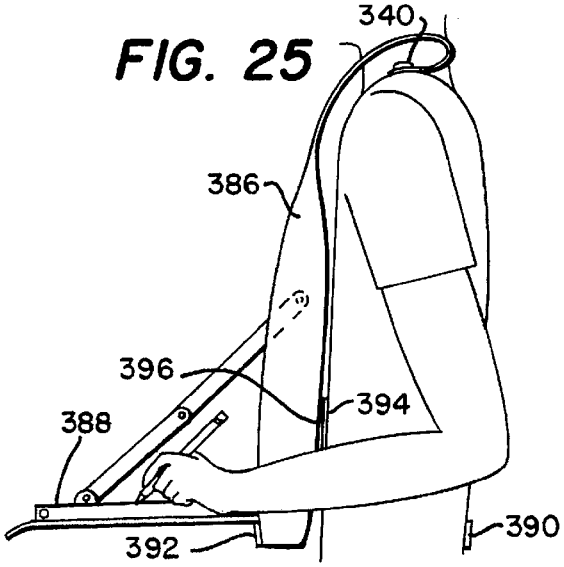
FIG. 25 shows a pouch with a work tray which is pivotable from a vertical carried position within a pouch to a horizontally supported orientation for work activities on the tray.

FIG. 25 depicts an alternative embodiment of a detachably attachable flipover pouch 386, which pouch is provided with a worktable 388, which, for example, may be a writing table, as depicted in FIG. 25, or may be any other worktray or table, such as a computer keyboard or a computer screen or the like (not shown). Again, where a worktable is involved, it would be additionally advantageous, along with rear support patches 390 and 392, to also provide front support hook-and-loop patches 394 and 396.

Another alternative embodiment, as depicted in FIG. 26, provides a flipover pouch 398, which is provided with padded compartments 400, 402 and 404, which may be accessible through openings 406, 408 and 410 from the back or other corresponding openings from the front (not shown) for embodiments in which the padded compartments are used for expensive equipment, such as camera lenses 412, or camera lens filter 414 or even high quality film 416, the rear openings 406, 408 and 410 may be eliminated altogether, so that only forward opening compartments are provided, thereby preventing unwanted access by others while the cameraperson is occupied with photographing or other activities. Although the padded compartment pouch 298 is depicted with a detachable strap connector 417 and a detachable pull strap connector 418, it will be understood by those skilled in the art that the pouches may be secured directly to a camera vest or other garment as with stitching, or the pouches may be secured with snaps rather than the zipper-type detachable connectors 417 and 418, as depicted in FIG. 26.

Figure 27:
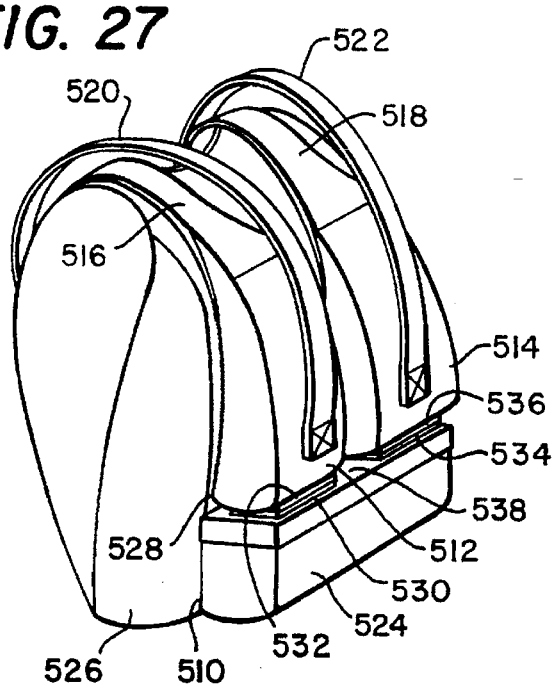
FIG. 27 is a perspective view of an alternative embodiment of a carrying device with flipover pouches, according to the present invention.

FIG. 27 schematically shows a perspective view of yet another alternative embodiment of an inventive carrying device 510 having flipover pouches 512 and 514. In this embodiment, the support straps 516 and 518 and the pull straps 520 and 522 may be constructed according to any of the alternative embodiments of construction as depicted in the figures, above, for the inventive carrying device. The motion-inhibiting feature of the invention is provided with an auxiliary pack 524, which is secured toward the bottom of a main pack 526, or merely secured to the bottom of a back panel 528 where an embodiment without a main pack is employed. The pouches 512 and 514 are provided with motion-inhibiting patches, such as hook-and-loop patches 530 and 532 and 534 and 536. Portions of the patches 530 and 534, according to this alternative embodiment, will be affixed to a top panel 538 of the auxiliary pack 524. Other portions of the stabilization patches will be affixed to the bottom of flipover pouches 512 and 514.

Figure 28:
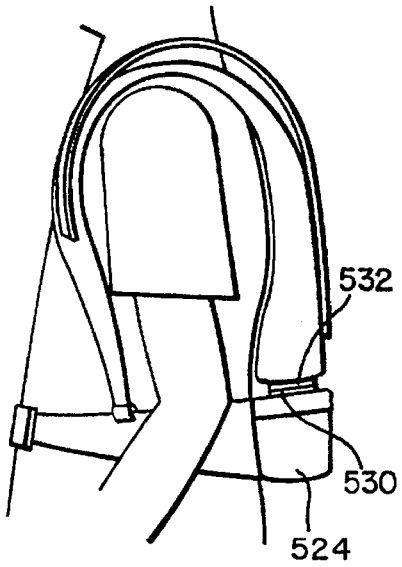
FIG. 28 is a side plan view of an alternative embodiment of a carrying device, as in FIG. 27, shown in position on a wearer.

FIG. 28 depicts a side plan view of the pouch with horizontally-disposed motion inhibitors 530 and 532, similar to those as depicted in FIG. 27, but in which the auxiliary pack 524 is applied directly to the back panel of a garment without a main pack 526 disposed therebetween. For example, as schematically depicted in FIG. 28, where the carrying device is a garment which is provided with pouches, the auxiliary pack 524 may be constructed directly to a back panel 528 of the garment, such as a vest, dress, overalls, jacket or the like.

Figure 29:
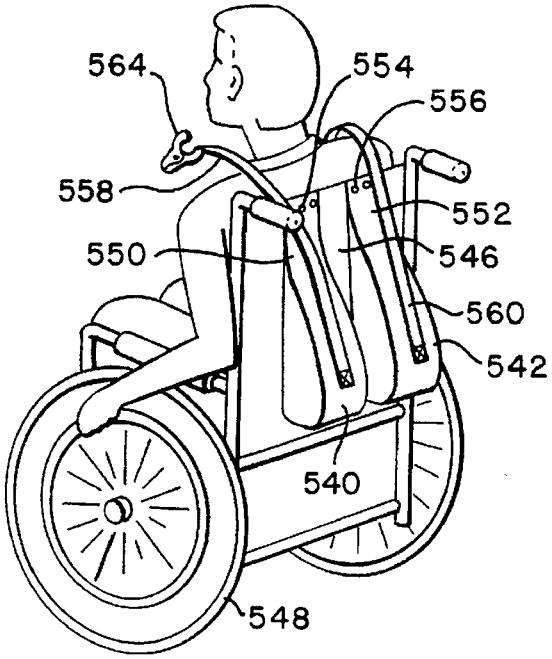
FIG. 29 is a schematic perspective view of the invention, particularly the inventive flipover pouches, shown attached to a wheelchair back panel for convenient access by an individual whose mobility depends upon a wheelchair.

FIG. 29 depicts flipover pouches 540 and 542 attached to a back panel 546 of a wheelchair 548, according to the present invention. The support straps for the pouches 550 and 552 may be attached either rigidly with stitching or detachably with snaps or buttons at 554 and 556, as shown in FIG. 29. Pull straps 558 and 560 are also depicted in FIG. 29. Advantageously, the pull straps 560 will be provided with means, such as a clip 564, by which the user of the wheelchair may simply clip the straps into a convenient position as on one of their garments or at a convenient location on the wheelchair, such as at an armrest, for pulling access to the pouches.

Figure 30:
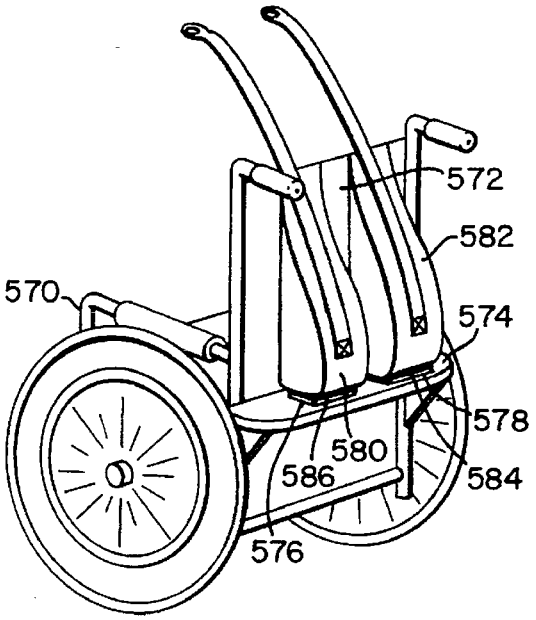
FIG. 30 is an alternative design of flipover pouches for a carrying device, which pouches are similar in construction to those set forth in FIG. 27.

FIG. 30 depicts a wheelchair 570 with an alternative embodiment of the inventive flipover pouches, similar to those depicted in FIGS. 27 and 28, in which the back panel of the wheelchair 572 is provided with a horizontal shelf 574 to which motion-inhibiting patches 576 and 578 are attached, corresponding to rear-supported positions for flipover pouches 580 and 582 and corresponding hook-and-loop patches 584 and 586.

Figure 31:
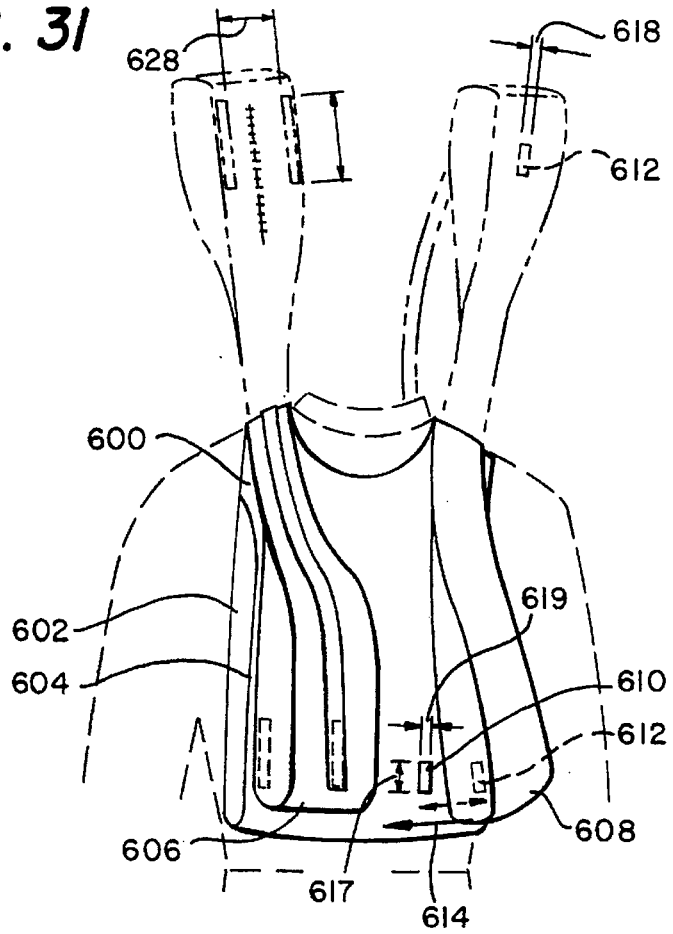
FIG. 31 is a schematic perspective view depicting one alternative, preferred hook-and-loop patch construction for flipover pouches, according to the present invention, depicting both single vertical hook-and-loop mating patches and double vertical hook-and-loop mating patches.

FIG. 31 schematically depicts an alternative embodiment of a backpack 600, which may be either a carrying device with a main pack 602 or simply a carrying device garment with a back panel 604 to which flipover pouches 606 and 608 may be stabilized in a rear-supported position with attached motion-inhibiting patches according to the invention. In this embodiment, attachment of pouches 606 and 608 in a vertically extended downward position at locations preferred by the wearer may be facilitated with a unique design of the patches. As, for example, in one embodiment of this unique design, a small piece of hook-and-loop material 610, having a narrow horizontal width 618, is positioned on the back panel 604 of the carrying device and a corresponding small piece 612, having a similar narrow width 619, is secured centrally located on pouch 608. If the pouch is flipped rearward in an off-center condition, the hook-and-loop patches 610 and 612 will not initially become secured. However, with minimal movement of the pouch 608 due to the downward force of gravity, the pouch will move, as shown with arrow 614, into vertical alignment between patches 610 and 612 and will become secured in a straight-down position. This position will normally be aesthetically pleasing, as well as comfortable and ergonomically sound for carrying purposes. It will be seen that the maximum misalignment of the pouch, whether pivoting either clockwise or counterclockwise after the initial flip, will be the width 618 of pieces 610 and 612 of hook-and-loop material. Additional holding force may be obtained, using a pair of pieces or narrow strips 610 and 612, having a longer vertical length 616 and 617, or even by using vertical strips 620 and 622, corresponding to a pair of vertical strips 624 and 626 on the pouch 606. Even with a casual initial flip of the pouch 606, misalignment is seldom more than the entire width 628 of the pouch 606, so that, upon subsequent pivoting, as schematically represented with arrow 614, the narrow patches, whether vertically short or vertically long, will become aligned and attached for motion-inhibiting engagement.

Figure 32:
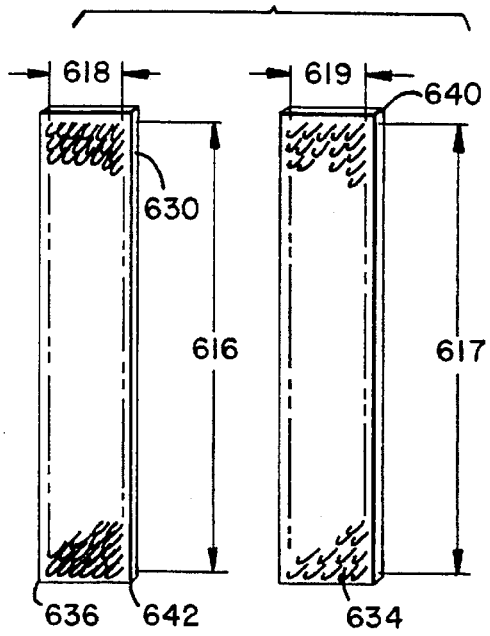
FIG. 32 shows a standard pair of thin vertical patches for use in the alternative embodiment, as depicted in FIG. 31.

With reference to FIG. 32, which depicts corresponding narrow pieces of hook-and-loop material 630 and 632, which are constructed on substantially flat backing material, with the hooks 634 and the loops 636 projecting substantially perpendicular from the flat backing material panels 640 and 642, respectively. While in most instances this configuration will adequately inhibit the motion of pouches, according to the present invention, when constructed according to FIG. 31, either with a single small piece, a single narrow strip or with double strips, as described above.

Figure 33:
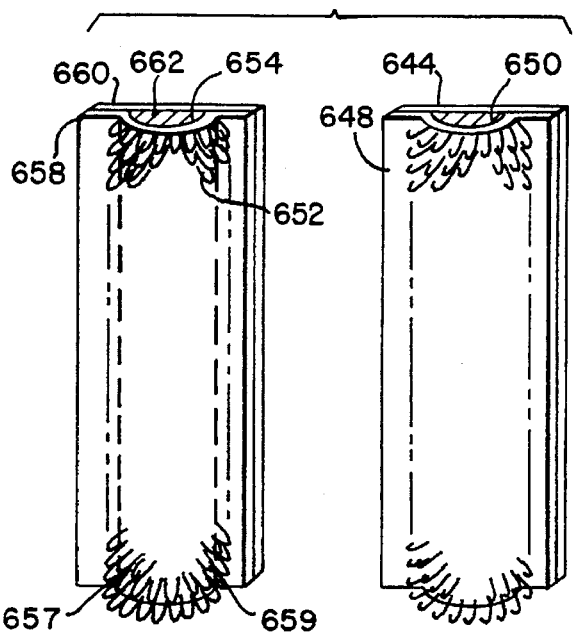
FIG. 33 depicts a pair of hook-and-loop patches, which have been unique modified to present a radius hook-and-loop configuration to facilitate secure attachment of the hook-and-loop material when constructed on a carrying device according to the alternative embodiment of FIG. 31.

Referring to FIG. 33, an alternative embodiment of mating hook-and-loop pieces or vertical strips 644 and 646 are depicted in which the surface 648 of the hook material is in a convex curve shape 650, as with the arc of a cylinder. Similarly, the loop material is formed so that its surface 652 is in the shape of the arc of a cylinder 654. This unique construction may be advantageous for better, consistent positioning at the time of engagement. Thus, upon flipping the pouch over and subsequent pivoting to a vertically downward position, the engagement between the curved surfaces of the hooked material and the surface of the looped material results in an engagement which is secure and less than the entire maximum width of either of the vertical strips. To form hook-and-loop material in this configuration, it has been found that stitching at 657 the backing panel 658 to a second support panel 660, inserting rounded or half-rounded support material 662, such as foam or flexible plastic having an cylindrical arc 650, then stitching at 659 the other side of the hook-and-loop backing panel 658 to the other side of the second support panel 660 provides the arc shape 650 exterior surface. This construction can be applied to either the hook material or the loop material, and preferably to both.

While the invention has been disclosed in connection with preferred embodiments, it is not intended to be limited to the specific embodiments as disclosed, but, to the contrary, the scope is intended to cover alternatives and equivalents as may be within the scope of the claims below.

What is claimed is:

1. A carrying device to be worn by a person having an accessible area in from of said person's torso and an inaccessible area away from said accessible front torso area, said carrying device comprising:

(a) a pouch support strap attached at a first end thereof to said carrying device so that said first end is fixed relative to the person wearing said carrying device and having a second end which is movable, relative to the person wearing said carrying device, between one position and another position, without removing said carrying device;

(b) a pouch attached to said second end of said pouch support strap so that said pouch is supported by said pouch support strap in a first supported position adjacent said inaccessible area when said pouch support strap is in said one position and so that upon moving said second end of said pouch support strap to said other position, without moving said first end thereof, said pouch is supported by said pouch support strap in a second supported position adjacent said accessible area in front of said person's torso;

(c) means accessible by the person without removing the carrying device being worn, for non-detachably moving the pouch to said second supported position adjacent said accessible area; and (d) a first opening formed in said pouch for allowing access into said pouch from said second support position;

(e) a main pack supported by shoulder straps interposed between the person's back and the pouch in the first position;

(f) a back panel on the main pack adjacent the pouch in the first supported position; and (g) a motion inhibitor attached to the back panel for releasably holding the pouch in the first supported position and for releasing the pouch to allow it to be non-detachably moved to the second support position.

2. A carrying device as in claim 1 wherein the motion inhibitor comprises:

(a) a first patch of hook-and-loop material affixed to the back panel of the main pack; and (b) a second patch of hook-and-loop material, of the type for releasable mating coupling with the first patch of hook-and-loop material, attached to the pouch and aligned for releasable coupling with the first patch of hook-and-loop material when the pouch is in the first position.

3. A carrying device as in claim 2 further comprising:

(a) a top and a bottom portion of the main pack;

(b) a handle affixed to the top portion of the main pack;

(c) a bottom of the pouch; and (d) wherein the main pack bottom position and the pouch bottom terminate substantially aligned when the pouch is in the first position so that the pouch and main pack can be set stably on a substantially flat support surface.

4. A carrying device as in claim 3 further comprising:

(a) a selectively closeable top of the main pack;

(b) said first opening is closeable; and (c) a second closeable opening in the pouch allowing access into the pouch when it is in the first position supported at the user's back.

5. A carrying device as in claim 1 further comprising a removable waterproof liner sized for insertion into the main pack.

6. A carrying device as in claim 1 further comprising a removable waterproof liner sized for insertion into the pouch.

7. A carrying device as in claim 1 further comprising a detachable side pocket.

8. A carrying device as in claim 1 further comprising a waterproof liner sized for insertion into the side pocket.

9. A carrying device as in claim 5 wherein the pouch further comprises a support band attached to the pouch spaced above the first opening of the pouch so that elongated objects placed in the envelope and extending upward through the opening can be held at an upper portion by the support band.

* * * * *